US007409801B2

(12) United States Patent
Pfeiffer

(10) Patent No.: US 7,409,801 B2
(45) Date of Patent: Aug. 12, 2008

(54) PREFABRICATED FOAM BLOCK CONCRETE FORMS WITH OPEN TOOTH CONNECTION MEANS

(75) Inventor: Henry E. Pfeiffer, Omaha, NE (US)

(73) Assignee: TriTex ICF Products, Inc., Omaha, NE (US)

( * ) Notice: Subject to any disclaimer, the term of this patent is extended or adjusted under 35 U.S.C. 154(b) by 314 days.

(21) Appl. No.: 10/906,794

(22) Filed: Mar. 7, 2005

(65) Prior Publication Data

US 2005/0204679 A1 Sep. 22, 2005

Related U.S. Application Data

(60) Provisional application No. 60/521,230, filed on Mar. 16, 2004.

(51) Int. Cl.
*E04B 2/86* (2006.01)

(52) U.S. Cl. ..... 52/426; 52/591.3; 52/592.2; 52/592.6

(58) Field of Classification Search ..... 52/426, 52/591.1, 591, 592.5, 592.6, 309.15, 309.17, 52/591.3, 592.2, 591.2
See application file for complete search history.

(56) References Cited

U.S. PATENT DOCUMENTS 1,694,665 A * 12/1928 Parker ..... 52/591.2
1,796,973 A * 3/1931 Wright ..... 52/591.2
1,836,408 A * 12/1931 Sutton ..... 52/591.2
1,895,801 A * 1/1933 Keller ..... 52/591.2
3,383,817 A 5/1968 Gregori
3,552,076 A 1/1971 Gregori
3,740,909 A * 6/1973 Stinnes ..... 52/562.5
3,788,020 A 1/1974 Gregori
3,895,469 A 7/1975 Kapitan
3,924,376 A * 12/1975 Tsurumi ..... 52/591.1
4,223,501 A 9/1980 Delozier
4,229,920 A 10/1980 Lount
4,439,967 A 4/1984 Dielenberg
4,516,372 A 5/1985 Grutsch
4,577,447 A 3/1986 Doran (Continued)

FOREIGN PATENT DOCUMENTS

CA 2142515 8/1995

(Continued)

*Primary Examiner*—M. Safavi
(74) *Attorney, Agent, or Firm*—Blackwell Sanders LLP

(57) ABSTRACT

A foam block concrete form including a pair of opposing foam panels spaced parallel from each other, a plurality of ties positioned transverse to and between the pair of opposed panels for holding the panels in spaced apart parallel relationship to each other, a single row of alternating teeth and sockets positioned and located along opposing horizontal longitudinal edges of each panel to enable the panels to be removably engaged with either opposed horizontal longitudinal edge of an adjacent vertically positioned panel having a substantially identical array of teeth and sockets formed along its opposed horizontal longitudinal edges, and a substantially flat planar surface located adjacent the single row of alternating teeth and sockets thereby providing a mechanism for facilitating the removal of water and other debris which may accumulate within the sockets or spaces formed between the teeth. The substantially flat surface may also be tapered to further facilitate the removal of water and other debris from within the alternating sockets.

40 Claims, 3 Drawing Sheets

U.S. PATENT DOCUMENTS 4,604,843 A 8/1986 Ott et al.
4,698,947 A 10/1987 McKay
4,706,429 A * 11/1987 Young ..... 52/426
4,730,422 A 3/1988 Young
4,731,968 A 3/1988 Obino
4,742,659 A 5/1988 Meilleur
4,750,307 A 6/1988 Slager
4,788,020 A 11/1988 Yampolsky et al.
4,825,618 A * 5/1989 Blevins ..... 52/592.5
4,852,317 A 8/1989 Schiavello et al.
4,860,515 A 8/1989 Browning, Jr.
4,866,891 A 9/1989 Young
4,879,855 A 11/1989 Berrenberg
4,884,382 A * 12/1989 Horobin ..... 52/426
4,885,888 A 12/1989 Young
4,889,310 A 12/1989 Boeshart
4,894,969 A 1/1990 Horobin
4,901,494 A 2/1990 Miller et al.
4,916,879 A 4/1990 Boeshart
4,936,540 A 6/1990 Boeshart
4,967,528 A 11/1990 Doran
5,014,480 A 5/1991 Guarriello et al.
5,024,035 A 6/1991 Hanson et al.
5,060,446 A 10/1991 Beliveau
5,065,561 A 11/1991 Mason
5,086,600 A * 2/1992 Holland et al. ..... 52/592.6
5,122,015 A 6/1992 Shen
5,123,222 A 6/1992 Guarriello et al.
5,163,261 A 11/1992 O'Neill
5,351,455 A * 10/1994 Schoonover et al. ..... 52/426
5,390,459 A 2/1995 Mensen
5,428,933 A * 7/1995 Philippe ..... 52/426
5,454,199 A 10/1995 Blom et al.
5,459,971 A 10/1995 Sparkman
5,465,542 A 11/1995 Terry
5,491,949 A 2/1996 De Moor
5,566,518 A * 10/1996 Martin et al. ..... 52/426
5,568,710 A 10/1996 Smith et al.
5,570,552 A 11/1996 Nehring
5,596,855 A 1/1997 Batch
5,611,183 A 3/1997 Kim
5,617,693 A 4/1997 Hefner
5,625,989 A 5/1997 Brubaker et al.
5,657,600 A 8/1997 Mensen
5,699,640 A * 12/1997 Bourgeois et al. ..... 52/592.6
5,701,710 A 12/1997 Tremelling
5,704,180 A 1/1998 Boeck
5,709,060 A 1/1998 Vaughan et al.
5,735,093 A 4/1998 Grutsch
5,803,669 A 9/1998 Bullard
5,809,727 A 9/1998 Mensen
5,809,728 A 9/1998 Tremelling
5,839,243 A * 11/1998 Martin ..... 52/592.6
5,845,449 A 12/1998 Vaughan et al.
5,852,907 A 12/1998 Tobin et al.
5,890,337 A 4/1999 Boeshart
5,896,714 A * 4/1999 Cymbala et al. ..... 52/426
5,930,958 A 8/1999 Stanley
6,070,380 A 6/2000 Meilleur
6,085,476 A * 7/2000 Jantzi et al. ..... 52/309.15
6,122,880 A * 9/2000 Kolb et al. ..... 52/592.6
6,230,462 B1 * 5/2001 Beliveau ..... 52/426
6,253,518 B1 * 7/2001 Azar ..... 52/592.6
6,253,519 B1 * 7/2001 Daniel ..... 52/591.1
6,321,496 B1 * 11/2001 Martin, Jr. ..... 52/592.6
6,401,419 B1 * 6/2002 Beliveau ..... 52/592.6
6,536,172 B1 * 3/2003 Amend ..... 52/426
6,820,384 B1 11/2004 Pfeiffer
2005/0223669 A1 * 10/2005 Cymbala et al. ..... 52/426
2006/0117693 A1 * 6/2006 Garrett ..... 52/426

FOREIGN PATENT DOCUMENTS

FR 2394647 1/1979
GB 1385045 2/1975

* cited by examiner

PREFABRICATED FOAM BLOCK CONCRETE FORMS WITH OPEN TOOTH CONNECTION MEANS

CROSS-REFERENCE TO RELATED APPLICATION

This patent application claims priority to U.S. Provisional Patent Application Ser. No. 60/521,230 filed Mar. 16, 2004.

BACKGROUND OF THE INVENTION

The present invention relates to Insulating Concrete Form systems utilizing foam block forms and, more specifically, to improvements to the foam panels, the foam corner panels and the interlocking connection means associated therewith.

Insulating Concrete Form (ICF) systems are known and serve to both contain fluid concrete while it solidifies and provide insulation for the finished structure. Such systems utilize a plurality of individual units, panels or blocks aligned horizontally and vertically in an interlocking arrangement to create forms for concrete walls. Each block comprises a pair of foamed panels which are retained in a spaced relationship parallel to each other by a plurality of ties.

The spacing ties are truss-like and include opposing flange portions which reside within respective opposing foam panels. The opposing flange portions are separated by an intermediate web portion connected therebetween, enabling the tie to hold and secure the panel portions. Some prior art designs teach slide-in ties having flanges which are configured to be complementary with slots formed in the panels. Such block designs have the disadvantage of requiring worksite assembly.

Other prior art ICF designs teach the use of prefabricated foam block concrete forms in which opposing flanges of each tie are molded into respective opposing foam walls of the foam block. Many of these ICF designs teach the use of a foam form block having a lower or bottom longitudinal edge which is designed to engageably receive only the upper or top longitudinal edge of a similar block positioned therebelow, and an upper or top longitudinal edge which is designed to engageably receive only the lower or bottom longitudinal edge of a similar block placed thereupon.

The interlocking mechanisms associated with many of the prior art ICF designs also include spaces or sockets formed between the teeth or projection patterns associated therewith wherein water, contaminants, and other debris can accumulate and can be trapped during installation and construction of a wall structure using an ICF system. Since these ICF forms are exposed to inclement weather during installation at a particular site, water and other debris becomes trapped in the sockets and spaces formed between the connection means and no means are provided for allowing such debris and water to be removed or to escape prior to connecting adjacent ICF forms. If water and/or debris is allowed to remain in such spaces or sockets, the integrity of the joinder between two adjacent ICF forms is compromised since such water and/or debris hinders and interferes with a good solid connection between adjacent ICF forms. This not only weakens the joinder since a full and tight seat cannot be achieved between adjacent ICF forms, but it also affects the insulation capabilities of the ICF forms since cracks and other spaces may exist between adjacent forms due to the trapped and accumulated water and debris. Also, depending upon the time of year, trapped water may also freeze and cause other structural instability problems.

Weakening of the joinder connection between two adjacent ICF forms due to trapped water and/or debris can likewise cause the wall structure formed by the ICF system to be displaced due to the outward forces created when concrete is poured therebetween. It is therefore desirable that the interlocking connection means associated with any ICF system include a mechanism to prevent the possibility of water and/or other debris being trapped within the spaces or sockets associated with the interlocking connection means.

It is also known in the art to design ties for a foam form block that will produce two independently structurally sound half-height blocks if cut laterally in half. However, in most prior art designs, in the event that it is necessary to remove the top half of the block along the horizontal midpoint, the top half of the block becomes unusable waste, due to the fact that these ties are not used with foam blocks that are designed to be vertically reversibly interlocking with adjacent blocks. Furthermore, these prior art tie designs fail to optimize distribution of the flow of fluid concrete across the web portion of the tie. Rather, they serve to impede even distribution of the fluid concrete between the foam panels.

During installation and construction, it is also desirable to easily locate the opposing flanges associated with the spacing ties since these flanges serve as anchoring studs for a wide variety of different applications. It is therefore also desirable to have indicator means associated with the foam panels forming the ICF system to easily facilitate the location of the tie flanges.

Accordingly, the present invention is directed to overcoming one or more of the problems as set forth above.

SUMMARY OF THE INVENTION

The apparatus of the present invention overcomes the weaknesses and disadvantages associated with prior art designs and teaches a more versatile tie and block design. The block of the present invention is a pre-constructed unit including a plurality of tie members spaced apart from, and parallel to, one another.

The block of the present invention can be constructed in any of a variety of configurations including, but not limited to, a substantially planar or straight block, a 90° corner block, and a block having at least two substantially planar segments oriented in angular relationship to each other at any angular displacement between 0° and 90°. The block is designed to yield a solid, continuous concrete wall construction when connected horizontally and vertically to blocks of similar construction.

Any block configuration will include an opposing pair of foam panels which are integrally connected together and held in spaced apart configuration by a plurality of ties positioned therebetween. A single array or row of alternating teeth and sockets are formed along opposing horizontal longitudinal edges of each panel to enable it to removably engage either opposing horizontal longitudinal edge of an adjacent vertically positioned panel having a substantially identical array of teeth and sockets formed along either longitudinal edge thereof. A substantially flat surface is located adjacent the single array of alternating teeth and sockets on each opposed horizontal longitudinal edge of each opposed panel forming the present block form, the substantially flat surface providing a means for allowing water and other debris to escape and not to be trapped in the sockets or spaces formed between the teeth. This promotes a better joinder between adjacent panels and facilitates a stronger and more stable wall structure when a plurality of the present block forms are interconnected to form a wall structure. This also improves the insulating capabilities of the present block forms.

In a preferred block form arrangement, the single array of alternating teeth and sockets associated with each opposing horizontal longitudinal edge of each opposed panel is positioned and located along the inside edge portion of each panel adjacent the space formed therebetween for receiving the fluid concrete. As a result, the substantially flat surface located adjacent the single array of alternating teeth and sockets is positioned along the outside edge portion of each panel thereby providing a path for any water and/or other debris which may accumulate within the alternating sockets to freely migrate away from and exit such sockets or spaces so that a tight seal and joinder can be achieved between the interlocking teeth and sockets associated with adjacent panels. The present substantially flat surface associated with each opposed horizontal longitudinal edge of each panel may also be tapered to further facilitate the removal of water or other debris which may accumulate within the alternating sockets. Similarly, arrays of alternating teeth and sockets are formed along opposing vertical end edges of each panel to enable one panel to removably engage either opposing vertical end of an adjacent horizontally positioned panel having a substantially identical array of teeth and sockets formed along either vertical end edge.

As a result, a planar block of the present invention can vertically and horizontally engageably receive adjacent whole or half planar or corner blocks of the present invention, regardless of the vertical orientation with respect to its horizontal longitudinal axis and regardless of the horizontal orientation with respect to its vertical axis. Likewise, a corner block of the present invention can vertically and horizontally engageably receive adjacent whole or half planar or corner blocks of the present invention, regardless of the vertical orientation with respect to its horizontal longitudinal axis and regardless of the horizontal orientation with respect to its vertical axis. The corner block of the present invention can, therefore, function as a left corner block or a right corner block, as well as provide two functional half corner block units when the corner block is divided along its horizontal midpoint. Other blocks having varying angular relationships between planar segments are likewise recognized and anticipated. To facilitate separating a block of planar or angular configuration along its horizontal midpoint, the outer surface of either opposing panel of each block is pre-marked along its horizontal midpoint.

Each tie has a web portion connecting opposing truss and flange members molded within opposing foam panels. The web is designed to provide centralized structural support not only within a whole block, but also within the half blocks created by dividing a whole block along its horizontal midpoint. At the same time, the tie web is designed to optimize the flow of liquid concrete poured between the opposing foam panels.

The web has a plurality of rebar retaining seats formed thereon so that a rebar rod or member can be gravitationally placed within a given seat regardless of vertical orientation of the associated whole or half, planar, corner, or other angularly constructed block with respect to its horizontal longitudinal axis. The rebar retaining seats of each tie are of sufficient dimension to allow an unstraight rebar member to be retained therein without imparting undesirable torque forces to the tie member. Furthermore, the seat dimensions allow for overlapping ends of longitudinally adjacent rebar members to be retained therein to create, in effect, a wireless contact splice when the ends are imbedded in hardened concrete.

The corner block of the present invention includes a corner tie having a pair of corner flanges connected to a structural web member, all of which are encapsulated within a foam outer corner panel member to which exterior siding or facade will be attached. A concrete-engaging member extends inwardly from the structural web of the corner tie beyond the inner surface of the outer corner panel to serve as an anchor, when surrounded by concrete poured between opposing corner panels, to prevent the corner tie from being ripped from the corner foam block unit when exterior siding is anchored thereto.

These and other objects and advantages of the present invention will become more apparent to those skilled in the art after consideration of the following specification taken in conjunction with the accompanying drawings wherein similar characters of reference refer to similar structures in each of the separate views.

DETAILED DESCRIPTION OF THE PREFERRED EMBODIMENTS

Figure 1:
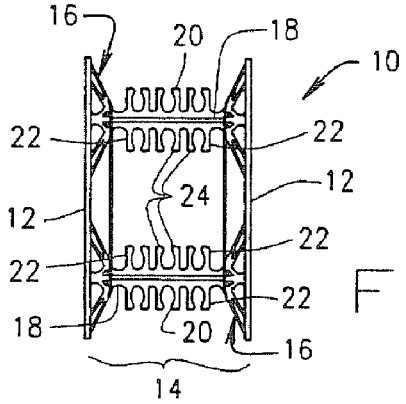
FIG. 1. is a side elevational view of one embodiment of a form tie constructed in accordance with the teachings of the present invention.

One embodiment of a form tie 10 of the present invention is illustrated in FIG. 1. The tie 10 includes a pair of flange members 12 separated by, and connected to, a web portion 14. The web portion 14 includes a pair of opposing truss members 16 connected by a pair of substantially identical transverse bridge members 18 having a plurality of rebar retaining seats 20 molded therein. In a preferred embodiment, the tie 10 is constructed from polypropylene. In other embodiments, the tie is constructed of metal, or other suitable materials.

The rebar seats 20 are substantially identical to each other in configuration, and are arranged in a pair of opposing rows along each transverse bridge 18. Each seat 20 includes a substantially U-shaped well formed by a pair of adjacent fingers 22. An inwardly spanning lateral knuckle or projection 24 is formed on the distal end of each pair of adjacent fingers 22, creating a distance between opposing projections 24 that is substantially less than the lateral distance between the proximal ends of adjacent fingers 22.

The length of the fingers 22 is chosen in conjunction with the lateral distance between proximal ends of adjacent fingers 22 to create a substantially U-shaped well that is capable of retaining a pair of rebar rods positioned diagonally therein.

Alternatively, the seats 20 are of such dimension that a single unstraight length of a rebar member may be retained therein without imparting undesirable torque to portions of the web 14. The projections 24 associated with a given seat 20 serve to help retain the rebar member therein. The fingers 22 forming each rebar seat 20 may likewise be tapered inwardly towards each other to further facilitate the holding of the rebar members within each respective seat 20.

Figure 2:
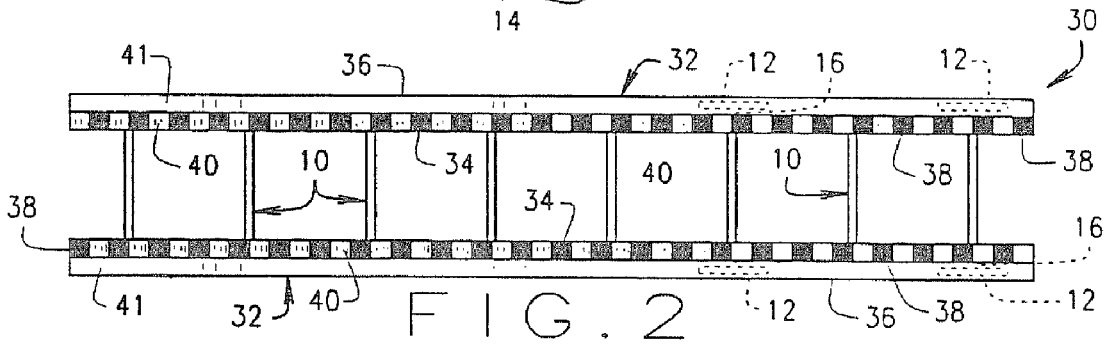
FIG. 2. is a top plan form view of a prefabricated straight foam block concrete form constructed in accordance with the teachings of the present invention.

A substantially straight or planar foam form block 30 having at least one substantially planar rectangular segment associated therewith is shown in FIG. 2. The form block 30 includes a pair of parallel opposing foam panels 32 retained in spaced apart relationship to each other by a plurality of form ties 10. As best illustrated in FIG. 2, the plurality of ties 10 extend transversely between opposing inner surfaces 34 of the opposing panels 32 such that the opposing flanges 12 and trusses 16 of each tie 10 are substantially retainably encapsulated within respective opposing foam panels 32 such that each flange 12 is seated inwardly from the outer surface 36 of the panel 32 within which it is encapsulated.

A single array or row of alternating, equi-dimensional teeth 38 and corresponding sockets or spaces 40 are formed in the opposing horizontal top and bottom longitudinal edges of the panels 32 as best illustrated in FIG. 2. In a preferred embodiment, the single row of alternating teeth 38 and sockets 40 associated with each panel 32 is positioned and located adjacent the opposing inner surfaces 34 of the opposing panels 32 forming block 30. As best seen in FIG. 2, the single row of alternating teeth and sockets associated with one of the opposing panels 32 forming block 30 is horizontally offset from the single row of alternating teeth and sockets associated with the other opposing panel 32 forming block 30 by the distance of one side of one tooth 38. In other words, each tooth 38 associated with one panel 32 forming block 30 is positioned directly opposite to and is horizontally aligned with a socket 40 associated with the other panel 32 forming block 30. Employing such an offset tooth and socket configuration along the opposing longitudinal edges of a pair of panels 32 forming block 30 yields a panel 32 and block 30 having opposing longitudinal edges capable of engagingly receiving either opposing longitudinal edge of an adjacent similarly configured panel 32 forming block 30 when such panels 32 and blocks 30 are vertically stacked one on top of the other. This means that one block 30 can be engaged with a similar block 30 in a vertical arrangement regardless of whether the top or bottom edge surfaces of one block 30 is engaged with the top or bottom edge surfaces of a similarly configured block 30. This is extremely important during installation and construction of wall systems using the present blocks 30, since both the top and bottom surfaces of one block 30 will engage the top and bottom surfaces of a similarly configured block 30. This speeds up installation and construction of wall systems using the present invention and eliminates the possibility of improperly mating opposed surfaces of blocks 30 during installation.

Figure 3:
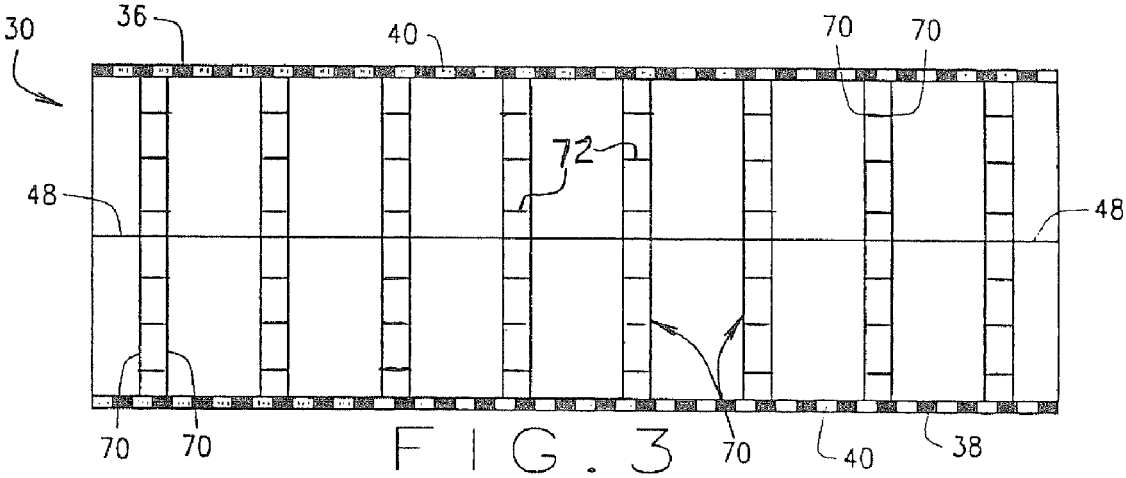
FIG. 3. is a side elevational view of the prefabricated straight foam block concrete form of FIG. 2.
Figure 4:
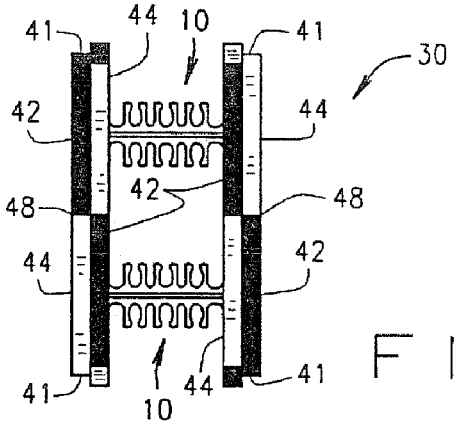
FIG. 4. is an end elevational view of the prefabricated straight foam block concrete form of FIG. 2.

The same offset arrangement between the single row of alternating teeth 38 and sockets 40 is likewise true between the top and bottom horizontal longitudinal edges of a single panel 32. This offset arrangement is illustrated in FIGS. 3 and 4 wherein the single row of alternating teeth 38 and sockets 40 associated with the top horizontal longitudinal edge of each panel 32 is offset from the single row of alternating teeth 38 and sockets 40 associated with the bottom horizontal longitudinal edge of the same panel 32 by the distance of one side of one tooth 38. Here again, a tooth 38 located on the top longitudinal edge of panel 32 would be vertically aligned with a socket 40 positioned and located on the bottom longitudinal edge portion of the same panel 32. This offset configuration likewise contributes to the versatility and flexibility of each panel 32 and each block 30 formed therefrom enabling such panels 32 and blocks 30 to be engageably received one on top of the other regardless of the vertical orientation of the panels 32 or blocks 30. As a result, the blocks 30 employing panels 32 in the configuration illustrated in FIGS. 2-4 can be engageably stacked upon and below adjacent blocks 30 regardless of the vertical orientation of the panels 32 relative to each other around their longitudinal and vertical axis.

Each panel 32 likewise includes a substantially flat planar surface 41 which extends substantially the full length of the opposing horizontal top and bottom longitudinal edges of each panel 32 as best illustrated in FIG. 2. This substantially flat surface 41 is positioned and located adjacent the single row of alternating teeth 38 and sockets 40 associated with each panel 32 and, in the preferred embodiment, the surface 41 is positioned and located adjacent the outer surface 36 of each panel 32. Since the surface 41 extends adjacent substantially the full length of the single row of alternating teeth 38 and sockets 40 associated with each opposed longitudinal edge of each panel 32, no cavities or trapped spaces are associated with any of the opposing longitudinal edges of each panel 32. As a result, if any water, debris or other contaminants fall onto, accumulate, or otherwise reside in the spaces or sockets 40 during installation and construction of a particular wall structure utilizing a plurality of blocks 30, there is no possibility that such water, debris of other contaminants will be trapped within the spaces or sockets 40 since such spaces or sockets 40 are open on both opposite sides thereof to the substantially flat surface 41 on one side and to the inner surface 34 on the opposite side thereof. This means that any water, debris or other contaminants can freely migrate and exit the spaces or sockets 40, such as by wind, mechanical blowing means, sweeping action, or other means, so that a tight seal and joinder can be achieved between the interlocking teeth 38 and sockets 40 associated with adjacent panels 32 when adjacent blocks 30 are vertically stacked one upon the other. The substantially flat surface 41 can likewise be formed so as to taper away from the single row of teeth 38 and sockets 40 towards the outer surface 36 of each respective panel 32 to further facilitate the free flow and removal of water or other debris and/or contaminants which may accumulate within the sockets 40 during installation and construction. This makes for a stronger and tighter seal between interlocking surfaces thereby substantially improving the overall strength and stability of a wall structure constructed using the present blocks 30.

Although the position and location of the single row of alternating teeth 38 and sockets or spaces 40 as shown in FIGS. 2-4 is generally preferred, it is also anticipated and recognized that the single row of alternating teeth 38 and sockets or spaces 40 associated with each horizontal top and bottom longitudinal edge of each panel 32 can be positioned anywhere along such edge surface such as adjacent the outer surface 36 of each panel 32, or such connecting or engaging means can be positioned intermediate the inner surface 34 and the outer surface 36 associated with each panel 32. In the situation where the single row of alternating teeth 38 and spaces or sockets 40 are positioned and located adjacent the outer surface 36 of each panel 32, the substantially flat surface 41 will then be positioned and located adjacent such engagement means and adjacent the inner surface 34 of each panel 32. Similarly, if the single row of alternating teeth 38 and sockets or spaces 40 is positioned along the length of the opposed horizontal longitudinal edges of each panel 32 intermediate the inner and outer surfaces 34 and 36 respectively, then a substantially flat surface 41 would be located adjacent both opposite sides of the single row of alternating teeth and sockets so as to maintain an open tooth configuration as previously explained.

Furthermore, in a preferred embodiment, the resultant space or socket 40 formed between adjacent teeth 38 is of such dimensions as to enable the socket 40 to snugly and engageably receive a tooth 38 therewithin. Advantageously, a bevel (not shown) can be formed along at least a portion of the perimeter of the distal end of each tooth 38 to serve as a guide to direct the tooth 38 within a corresponding socket 40. In one embodiment, (not shown) the bevel can be formed along and throughout the entire perimeter of the distal end. In another embodiment (not shown), the bevel can be formed along only a portion of the perimeter of the distal end such as along the two opposing sides of the teeth 38 that will engage the teeth 38 on either side of the corresponding socket 40.

As with the opposing longitudinal edges of the panels 32, the opposing vertical ends of the panels 32 likewise have an array of teeth 42 and sockets 44 formed therein to engageably receive either opposing vertical end of similarly configured panels 32 thereby yielding blocks 30 that can engageably receive horizontally adjacent blocks 30 regardless of the horizontal orientation of their vertical ends. In a preferred embodiment, the array includes two vertical columns of alternating teeth 42 and sockets 44 offset from each other by the length of one tooth 42, as more fully described in U.S. Pat. No. 6,820,384, which patent is owned by the present Assignee and which disclosure is incorporated herein by reference. In this arrangement, the location of the teeth 42 associated with one of the vertical longitudinal edges of the panels 32 correspond with the location of the sockets 44 associated with the other of the vertical longitudinal edges of the panels 32; and the location of the sockets 44 associated with one of the vertical longitudinal edges of the panels 32 correspond with the location of the teeth 42 associated with the other of the vertical longitudinal edges of the panels 32. This offset arrangement is true both with respect to the opposed vertical longitudinal edges of a straight or planar panel as well as with respect to the vertical longitudinal edges of a corner or angular panel, and this offset arrangement is likewise true with respect to the vertical longitudinal edges located at each opposite end of a pair of opposed panels 32 forming the blocks 30.

The blocks 30 can also be divided into a maximum of two, equal, usable horizontal increments. Consequently, an elongated tooth 42 having a longitudinal length substantially equal to half the vertical height of a block 30 provides the maximum tooth strength for the maximum quantity of usable horizontal block increments. The elongated tooth 42 extends laterally inwardly from the adjacent surface of the panels 32 for substantially half the thickness of the panels 32 while extending uniformly outwardly from the vertical end of the panels 32 a predetermined distance. The elongated socket 44 is shaped and dimensioned so as to engageably receive an elongated tooth 42 therein.

In the event that it is desirable to laterally divide a straight block 30 in half, the exterior surface 36 of each panel 32 includes a mark or indicator 48 along its central longitudinal axis. The mark or indicator 48 aids in accurately severing a block 30 laterally into equal halves. As best shown in FIG. 4, the mark or indicator 48 is positioned between the upper and lower bridge members 18 associated with the plurality of form ties 10 such that severing of the block 30 will not interfere with either bridge member 18 associated with each tie 10, and one bridge member 18 will remain with each severed half of block 30 so that each half could be used thereby reducing waste.

Depending upon particular applications, it is also anticipated and recognized that a particular block 30 may be too long due to space requirements, or due to a particular wall structure design, and it may be desirable to vertically cut block 30 to achieve a particular configuration. The length of each tooth 38 laterally along the longitudinal axis of a particular panel 32 determines the usable incremental portions of a block 30 when vertically cut or separated. Thus, the smaller the lateral length of the tooth 38 along the longitudinal axis of the panels 32, the greater the quantity of available usable vertical increments of such block 30. However, the greater the lateral cross-sectional area of a tooth 38, the greater the strength of the tooth 38. Because of the present interlocking connection means, namely, the tooth and socket configuration associated with both the top and bottom longitudinal edge surfaces of each panel 32, each block 30 can be vertically severed and separated into any number of usable vertical increments or segments and each increment or segment can be used and engaged with other blocks 30 as explained above. In this regard, the design of tooth 38 should be of sufficient strength to effectively accomplish joinder with other blocks 30 and to effectively resist breakage when vertically severed. The greater the cross-sectional area of the teeth, the stronger the teeth and the greater the cross-sectional area of the spaces or sockets located therebetween. The greater the cross-sectional area of the spaces or sockets, the easier it is to remove water, debris or other contaminants therefrom to allow the block to be fully seated upon or below an adjacent block. Consequently, the optimum tooth dimension must balance the need for versatility in trimming the block into vertical segments with the need for tooth strength and easy removal of socket contaminants. The present interlocking connection means thereby further reduces overall construction costs and time since each block 30 can be effectively cut and divided, both vertically and horizontally, with all resultant pieces being usable for a particular application.

Figure 5:
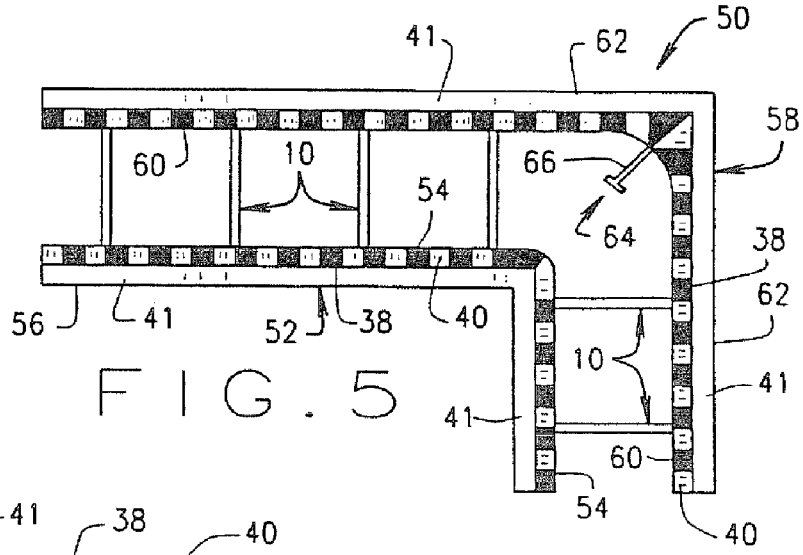
FIG. 5. is a top plan form view of another embodiment of a prefabricated corner foam block concrete form constructed in accordance with the teachings of the present invention.

A corner block 50 incorporating the present interlocking connection means is illustrated in FIG. 5 including an inner corner panel 52 having an inner surface 54 and an outer surface 56, an outer corner panel 58 having an inner surface 60 and an outer surface 62, and a plurality of ties 10 each having their respective opposing flange members 12 encapsulated within a respective panel 52 and 58, thereby retaining the inner surfaces 54 and 60 of the corner panels 52 and 58, respectively, in spaced apart opposing fashion. The corner block 50 has planar rectangular segments which intersect at approximately 90° to each other in an angular relationship. A corner tie 64 as more fully described in the present Assignee's U.S. Pat. No. 6,820,384 is encapsulated within the outer corner panel 58 at its corner. The corner tie 50 includes a pair of flange members (not shown) sharing a common end and extending perpendicularly to each other, the flange members being connected to each other by an array of web members (not shown). A concrete engaging member 66 extends inwardly from the web portion at substantially a 45° angle from either flange as shown in FIG. 5 and it extends inwardly beyond the inner surface 60 of the outer block 58, enabling the concrete engaging member 64 to be completely encapsulated by concrete when it is poured between the corner panels 52 and 58.

The corner block 50 includes the same interlocking connection means as discussed with respect to block 30. More particularly, the top and bottom horizontal longitudinal edges of both the inner corner panel 52 and the outer corner panel 58 include a single row of alternating teeth 38 and spaces or sockets 40 in combination with a substantially flat surface 41 as described above with respect to block 30. The arrangement of the teeth 38 and spaces or sockets 40 in association with the inner and outer surfaces of corner panels 52 and 58 are likewise substantially identical as previously described with respect to block 30. In addition, the opposed offset relationship of the teeth 38 and sockets 40 associated with the top and bottom longitudinal surfaces of each respective corner panel 52 and 58 as well as the opposed offset relationship between the single row of alternating teeth 38 and sockets 40 associated with the opposed corner panels 52 and 58 of corner block 50 are likewise substantially identical as previously described with respect to block 30.

In addition, similar to block 30, in the event that it is desirable to laterally cut or divide a corner block 50 in half, the exterior surfaces 56 and 62 associated with the inner and outer corner panels 52 and 58 respectively likewise include a marker or indicator 68 along the respective central longitudinal axis. Here again, the marker or indicator 68 is positioned between the respective upper and lower bridge members 18 associated with the plurality of form ties 10 as previously explained such that each severed half portion is usable and engageable with a corresponding corner block 50.

In the field, pre-constructed planar or straight blocks 30 and corner blocks 50 are shipped to a construction site that has been prepared in readiness for a concrete wall to be constructed thereon. Due to the teeth 38 and socket 40 design formed along opposing longitudinal edges of the straight blocks 30 and corner blocks 50, the teeth 42 and socket 44 design formed in the opposing vertical ends of the straight blocks 30 and corner blocks 50, the substantially flat longitudinal surfaces 41, and the functionally vertical reversible design of the rebar retaining seats 20 of the ties 10, the straight blocks 30 and corner blocks 50 are functionally vertically and horizontally reversible. That is to say that the planar blocks 30 and corner blocks 50 can engageably receive a planar block 30 or a corner block 50 therebelow, thereupon, or adjacent its opposing vertical ends regardless of the vertical orientation of their opposing longitudinal edges and regardless of the horizontal orientation of their opposing vertical ends. Furthermore, rebar rods may be retainably placed within rebar seats 20 of a straight block 30 or a corner block 50 regardless of vertical orientation of the longitudinal edges of the blocks 30 and 50 and regardless of whether the blocks 30 and 50 have been laterally cut in half. This versatility of the straight blocks 30 and corner blocks 50 provides an ICF system that can be more rapidly constructed than prior art designs, thereby appreciably reducing labor costs.

Furthermore, due to the open web 14 design of the ties 10, optimal concrete flow is realized. As a result, even a viscous concrete mix can be poured without creating unwanted gaps and voids, thereby minimizing time spent pouring the concrete and enabling a greater variety of usable concrete mixes. Consequently, a wall of optimal concrete strength can be constructed in a reduced amount of time while producing a minimum of product waste and, ultimately, reducing labor costs.

Figure 6:
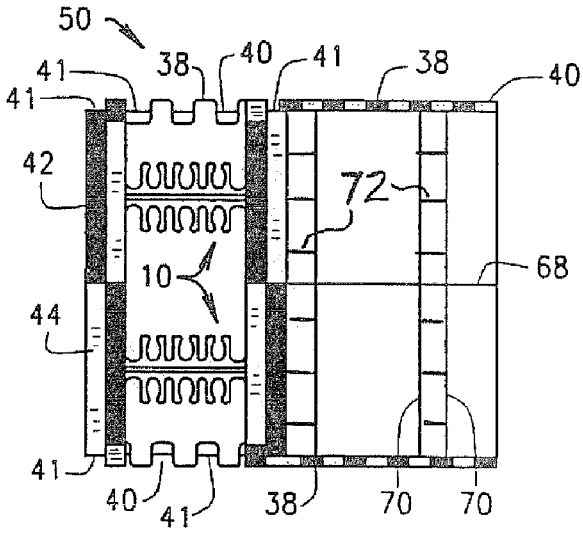
FIG. 6. is a left end elevational view of the prefabricated corner foam block concrete form of FIG. 5.
Figure 7:
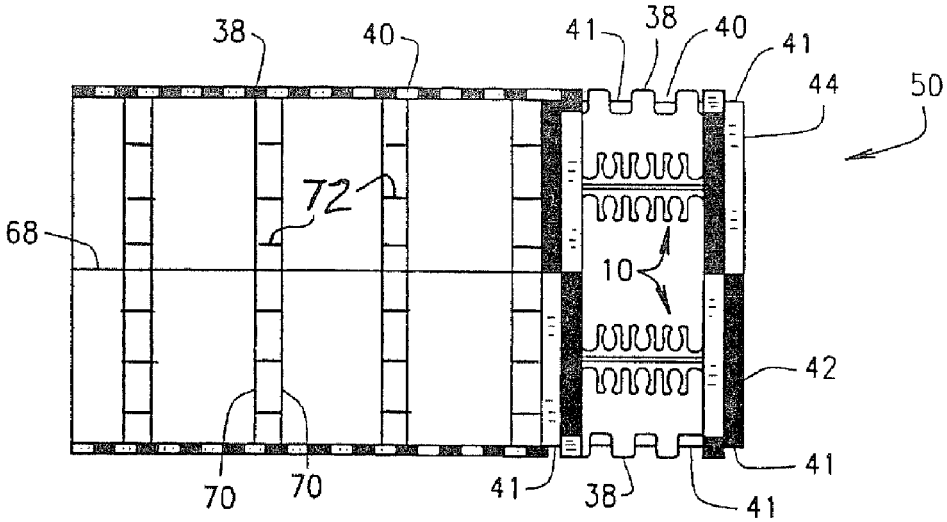
FIG. 7. is a side elevational view of the prefabricated corner foam block concrete form of FIG. 5.

The opposing flanges 12 of each form tie 10 run substantially the vertical height of the blocks 30 and 50, thereby providing strength throughout the height of the blocks 30 and 50 sufficient to prevent the opposing panels 32, 52 and 58 from being displaced by the outward forces created when concrete is poured therebetween. In a preferred embodiment, the flanges 12 are of sufficient height, width and thickness such that the flange 12 can serve as a stud to which interior and exterior facades can be anchored. The inner surface 34 and outer surface 36 of the block 30, as well as the outer surface 56 and outer surface 62 of the inner and outer corner panels 52 and 58 respectively are substantially flat surfaces. The panels 32, the inner corner panels 52 and the outer corner panels 58 are likewise of appropriate thickness with the flanges 12 being positioned inwardly from the outer surface of the panels 32, 52 and 58 by a sufficient distance to facilitate use as a stud. To facilitate locating the flanges 12 to serve as anchoring studs, a pair of flange indicators 70 are molded into the outer surface of the panels 32, 52 and 58 as shown in FIGS. 3, 6 and 7. A plurality of spaced horizontal indicators 72 are likewise molded into the outer surface of the panels and positioned between the pair of indicators 70 to further visually identify the location of the respective flanges 12. This ladder tie identification design makes it easy for a worker to quickly and easily identify and locate the flanges 12 associated with each respective tie 10 for both aligning the respective ties 10 when the blocks 30 and 50 are vertically stacked one upon another to create a wall structure, and for serving as anchoring studs. The indicators 72 can also be dimensionally spaced such that they can be used as a measuring guide when a particular block 30 and/or 50 needs to be horizontally or laterally cut offset from the centered indicator 48. For example, the indicators 72 may be spaced at intervals of one inch or some other predetermined distance to facilitate measuring and cutting such blocks at a location offset from the central longitudinal axis of the block.

As with the flanges 12 of the ties 10, the flanges associated with the corner ties 64 also serve as anchoring studs for exterior facades fastened to the corner block 50. The corner tie flanges are likewise spaced inwardly from their respective outer surface 62 by an appropriate distance so that they can serve as a stud or anchoring mechanism for attaching facade thereto. Flange indicator markings (not shown) located on the outer surface 62 of the outer corner panel 58 facilitate locating the corner tie flanges for anchoring the facade thereto. Once the poured concrete has cured, the concrete engaging member 66 prevents the corner tie 64 from being displaced from the corner block 50 due to any anchor forces incurred by the mounting of any facade thereto.

It is also recognized and anticipated that the panels 32, 52 and 58 can take on a wide variety of different dimensions and thicknesses so as to yield blocks 30 and 50 having an interior space or cavity adaptable for receiving fluid concrete therein which will yield a wide variety of different concrete wall thicknesses. For example, the panels and blocks of the present invention can be dimensioned so as to yield concrete wall thicknesses acceptable for both commercial and residential construction including using the prescriptive method for establishing insulating concrete forms in residential construction. This includes, but certainly is not limited to, yielding concrete walls having a thickness of three and a half inches, four inches, five and a half inches, six inches, seven and a half inches, eight inches, and so forth. In addition, it is also recognized and anticipated that the foam ties 10 and corner tie 64 can likewise be dimensioned having flange lengths and widths adaptable for a wide variety of different applications and for serving as anchoring studs. In this regard it is further recognized and anticipated that the blocks 30 and 50 may also take on a wide variety of lengths and heights and that any number of ties 10 may be employed at predetermined spaced intervals along the length of the block for particular applications. Still further, it is recognized and understood that any of a variety of dimensions for the ties 10 and 64, the panels 32, 52 and 58, and the blocks 30 and 50 may represent a preferred embodiment for a given ICF system.

Still further, although blocks 30 and 50 represent a substantially planar and a corner (90°) concrete form construction, it is recognized and anticipated that any angularly oriented block form construction can be constructed in accordance with the teachings of the present invention wherein each opposing panel forming a particular block construction can include two substantially planar segments positioned and located at any angular orientation relative to each other depending upon a particular application. This angular orientation can vary between 0° and 90° depending upon the particular application. Since the panels forming the block form are typically made of foam, each panel can be integrally formed using known fabrication techniques.

Figure 8:
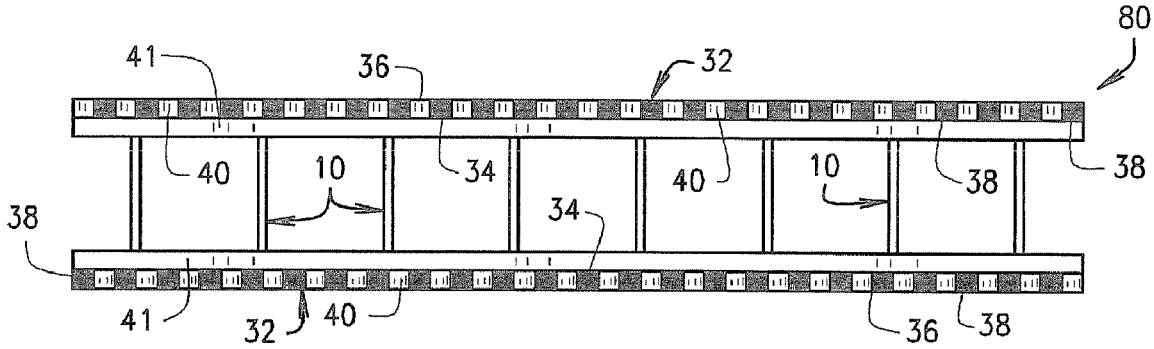
FIG. 8 is a top plan view of another embodiment of the prefabricated straight foam block concrete form of FIG. 2.
Figure 9:
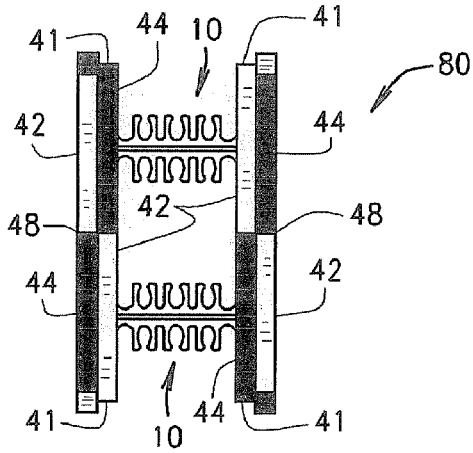
FIG. 9 is an end elevational view of the prefabricated straight foam block concrete form of FIG. 8.

FIGS. 8 and 9 represent another embodiment 80 of the prefabricated straight foam block concrete form illustrated in FIGS. 2-4 wherein the one row of alternating teeth 38 and sockets 40 and the substantially flat planar surface 41 have been reversed such that the row of alternating teeth and sockets are positioned and located adjacent the opposing outer surfaces of the pair of opposing panels 32 and the substantially flat planar surface is positioned and located adjacent the inner surface 34 of each panel 32. In all other respects, the construction and operation of the block 80 is substantially identical to the construction and operation of the block 30 and all of the reference numbers associated with block 30 are likewise equally applicable and associated with the block 80. It is further recognized and anticipated that the corner block 50 illustrated in FIGS. 5-7 can likewise be configured such that the one row of alternating teeth and sockets are positioned and located adjacent the opposing outer surfaces of the pair of opposing panels and the substantially flat planar surface is positioned and located adjacent the inner surface of each of the pair of panels. The same is likewise true with respect to any angularly oriented block form construction which is constructed in accordance with the teachings of the present invention.

As is evident from the foregoing description, certain aspects of the present invention are not limited by the particular details of the examples illustrated herein and it is therefore contemplated that other modifications and applications, or equivalents thereof, will occur to those skills in the art. It is accordingly intended that the claims shall cover all such modifications and applications that do not depart from the spirit and scope of the present invention.

Other aspects, objects and advantages of the present invention can be obtained from a study of the drawings and this disclosure.

What is claimed is:

1. A foam block concrete form having top and bottom longitudinal edges comprising:

a pair of opposing foam panels spaced apart from each other, each panel having at least one substantially planar rectangular segment having a horizontal pair of opposing longitudinal edges, a vertical pair of longitudinal edges, and inner and outer surfaces;

engagement means formed along the horizontal and vertical pairs of longitudinal edges associated with each panel for removably engaging one block form with other block forms having similar and complimentary engagement means associated therewith when placed both side-by-side and vertically adjacent thereto;

the engagement means associated with the horizontal pair of opposing longitudinal edges of each panel including one row of alternating teeth and sockets along each horizontal longitudinal edge and at least one substantially flat planar surface positioned and located adjacent said one row of alternating teeth and sockets and extending substantially the full length of each horizontal longitudinal edge, said one row of alternating teeth and sockets being positioned and located adjacent the outer surfaces of said opposed panels forming said block form and said at least one substantially flat planar surface being positioned and located adjacent the inner surface of each opposed panel forming said block form, the teeth associated with one of the opposed horizontal longitudinal edges being vertically aligned with the sockets associated with the other of the opposed horizontal longitudinal edges and the sockets associated with one of the opposed horizontal longitudinal edges being vertically aligned with the teeth associated with the other of the opposed horizontal longitudinal edges;

said pair of opposing panels forming said block form being disposed relative to each other such that the teeth associated with the row of alternating teeth and sockets located adjacent the opposed horizontal longitudinal edges of one of said pair of panels are horizontally aligned with the sockets associated with the row of alternating teeth and sockets located adjacent the opposed horizontal longitudinal edges of the other of said pair of panels; and a plurality of substantially planar ties positioned transverse to and between the pair of opposing foam panels, each tie extending between and connecting said foam panels;

said engagement means enabling one of said block forms to be engaged with a plurality of similarly constructed block forms in both a side-by-side arrangement and a vertically stacked arrangement regardless of the orientation of said block forms, the top longitudinal edges of one block form being engageable with both the top and bottom longitudinal edges of another similarly constructed block form and the bottom longitudinal edges of one block form being engageable with both the top and bottom longitudinal edges of another similarly constructed block form; and the sockets associated with each of the opposed horizontal longitudinal edges of each of said pair of opposed panels being open to said at least one substantially flat planar surface located and positioned adjacent thereto so as to facilitate the removal of any water, debris or other contaminants which may accumulate within the alternating sockets so that a tight seal and joinder can be achieved between the interlocking teeth and sockets associated with adjacent panels when similarly constructed block forms are vertically stacked one upon the other.

2. A foam block concrete form having top and bottom longitudinal edges comprising:

a pair of opposing foam panels spaced apart from each other, each panel having at least one substantially planar rectangular segment having a horizontal pair of opposing longitudinal edges, a vertical pair of longitudinal edges, and inner and outer surfaces;

engagement means formed along the horizontal and vertical pairs of longitudinal edges associated with each panel for removably engaging one block form with other block forms having similar and complimentary engagement means associated therewith when placed both side-by-side and vertically adjacent thereto;

the engagement means associated with the horizontal pair of opposing longitudinal edges of each panel including one row of alternating teeth and sockets along each horizontal longitudinal edge and at least one substantially flat planar surface positioned and located adjacent said one row of alternating teeth and sockets and extending substantially the full length of each horizontal longitudinal edge, the teeth associated with one of the opposed horizontal longitudinal edges being vertically aligned with the sockets associated with the other of the opposed horizontal longitudinal edges and the sockets associated with one of the opposed horizontal longitudinal edges being vertically aligned with the teeth associated with the other of the opposed horizontal longitudinal edges;

the engagement means associated with the vertical pair of opposed longitudinal edges of each panel including two columns of alternating teeth and sockets along each opposed vertical longitudinal edge, one column being offset from the other column, the location of the teeth associated with one of the opposed vertical longitudinal edges corresponding with the sockets associated with the other of the opposed vertical longitudinal edges and the location of the sockets associated with one of the opposed vertical longitudinal edges corresponding with the location of the teeth associated with the other of the opposed vertical longitudinal edges;

said pair of opposing panels forming said block form being disposed relative to each other such that the teeth associated with the row of alternating teeth and sockets located adjacent the opposed horizontal longitudinal edges of one of said pair of panels are horizontally aligned with the sockets associated with the row of alternating teeth and sockets located adjacent the opposed horizontal longitudinal edges of the other of said pair of panels; and a plurality of substantially planar ties positioned transverse to and between the pair of opposing foam panels, each tie extending between and connecting said foam panels;

said engagement means enabling one of said block forms to be engaged with a plurality of similarly constructed block forms in both a side-by-side arrangement and a vertically stacked arrangement regardless of the orientation of said block forms, the top longitudinal edges of one block form being engageable with both the top and bottom longitudinal edges of another similarly constructed block form and the bottom longitudinal edges of one block form being engageable with both the top and bottom longitudinal edges of another similarly constructed block form; and the sockets associated with each of the opposed horizontal longitudinal edges of each of said pair of opposed panels being open to said at least one substantially flat planar surface located and positioned adjacent thereto so as to facilitate the removal of any water, debris or other contaminants which may accumulate within the alternating sockets so that a tight seal and joinder can be achieved between the interlocking teeth and sockets associated with adjacent panels when similarly constructed block forms are vertically stacked one upon the other.

3. A foam block concrete form having top and bottom longitudinal edges comprising:

a pair of opposing foam panels spaced apart from each other, each panel having at least one substantially planar rectangular segment having a horizontal pair of opposing longitudinal edges, a vertical pair of longitudinal edges, and inner and outer surfaces;

engagement means formed along the horizontal and vertical pairs of longitudinal edges associated with each panel for removably engaging one block form with other block forms having similar and complimentary engagement means associated therewith when placed both side-by-side and vertically adjacent thereto;

the engagement means associated with the horizontal pair of opposing longitudinal edges of each panel including one row of alternating teeth and sockets along each horizontal longitudinal edge and at least one substantially flat planar surface positioned and located adjacent said one row of alternating teeth and sockets and extending substantially the full length of each horizontal longitudinal edge, said one row of alternating teeth and sockets being positioned and located adjacent the inner surfaces of said opposed panels forming said block form and said at least one substantially flat planar surface being positioned and located adjacent the outer surface of each opposed panel forming said block form, the teeth associated with one of the opposed horizontal longitudinal edges being vertically aligned with the sockets associated with the other of the opposed horizontal longitudinal edges and the sockets associated with one of the opposed horizontal longitudinal edges being vertically aligned with the teeth associated with the other of the opposed horizontal longitudinal edges;

said pair of opposing panels forming said block form being disposed relative to each other such that the teeth associated with the row of alternating teeth and sockets located adjacent the opposed horizontal longitudinal edges of one of said pair of panels are horizontally aligned with the sockets associated with the row of alternating teeth and sockets located adjacent the opposed horizontal longitudinal edges of the other of said pair of panels; and a plurality of substantially planar ties positioned transverse to and between the pair of opposing foam panels, each tie extending between and connecting said foam panels;

said engagement means enabling one of said block forms to be engaged with a plurality of similarly constructed block forms in both a side-by-side arrangement and a vertically stacked arrangement regardless of the orientation of said block forms, the top longitudinal edges of one block form being engageable with both the top and bottom longitudinal edges of another similarly constructed block form and the bottom longitudinal edges of one block form being engageable with both the top and bottom longitudinal edges of another similarly constructed block form; and the sockets associated with each of the opposed horizontal longitudinal edges of each of said pair of opposed panels being open to said at least one substantially flat planar surface located and positioned adjacent thereto so as to facilitate the removal of any water, debris or other contaminants which may accumulate within the alternating sockets so that a tight seal and joinder can be achieved between the interlocking teeth and sockets associated with adjacent panels when similarly constructed block forms are vertically stacked one upon the other.

4. The apparatus of claim 3 wherein said at least one substantially flat planar surface is formed so as to taper away from the row of alternating teeth and sockets associated with each opposed horizontal longitudinal edge of each opposed panel.

5. The apparatus of claim 3 wherein said engagement means associated with the vertical pair of opposed longitudinal edges of each panel includes two columns of alternating teeth and sockets along each opposed vertical longitudinal edge, one column being offset from the other column, the location of the teeth associated with one of the opposed vertical longitudinal edges corresponding with the sockets associated with the other of the opposed vertical longitudinal edges and the location of the sockets associated with one of the opposed vertical longitudinal edges corresponding with the location of the teeth associated with the other of the opposed vertical longitudinal edges.

6. The apparatus of claim 3 wherein the outer surface of each panel includes an indicator marking along its central longitudinal axis to aid in accurately severing said block form laterally into equal halves.

7. The apparatus of claim 3 wherein each opposing panel includes two substantially planar rectangular segments in angular relation to each other, each segment having at least one pair of opposing horizontal longitudinal edges.

8. The apparatus of claim 3 wherein each of said plurality of ties includes a web portion positioned between a pair of opposed flange members, each flange member being encapsulated within one of said respective pair of opposing panels.

9. The apparatus of claim 8 wherein each opposed flange member is substantially planar and of sufficient strength to function as an anchoring stud.

10. The apparatus of claim 8 wherein the opposing foam panels have a longitudinal axis and the opposed flange members have a longitudinal axis substantially equal in length to the transverse axis of the respective foam panels.

11. The apparatus of claim 8 wherein the web portion includes a pair of bridge members formed therein spaced parallel from each other and transverse to the opposed flange members.

12. The apparatus of claim 11 wherein each bridge member includes at least one rebar-retaining seat positioned therealong extending outwardly therefrom.

13. The apparatus of claim 12 wherein each bridge member includes at least one rebar-retaining seat positioned therealong extending inwardly therefrom.

14. The apparatus of claim 13 wherein said at least one rebar-retaining seat is sufficiently large to retainably receive plurality of rebar rods therewithin.

15. The apparatus of claim 11 wherein the opposing bridge members, in conjunction with each other, provide uniformly distributed structural support about the central lateral axis of the tie.

16. The apparatus of claim 15 wherein the opposing bridge members individually provide uniformly distributed structural support about their respective longitudinal axis when the tie is laterally cut in half.

17. The apparatus of claim 11 wherein each bridge member includes at least one rebar retaining seat positioned therealong extending outwardly therefrom and at least one rebar retaining seat positioned therealong extending inwardly therefrom.

18. The apparatus of claim 10 wherein the outer surface of each opposed panel forming said block form includes indicator means for locating the opposed flange members associated with each respective tie.

19. The apparatus of claim 18 wherein said flange indicator means includes a pair of vertically extending spaced indicator means identifying the outer edges of each respective flange member.

20. The apparatus of claim 19 wherein said flange indicator means further includes a plurality of spaced horizontal indicator means positioned and located between said pair of spaced vertical means to further identify the location of each respective flange member.

21. A foam block concrete form comprising:

a pair of opposing panels positioned and spaced apart in substantially parallel relationship to each other, each panel having top and bottom horizontal longitudinal edges, first and second end portions, and inner and outer surfaces;

a plurality of ties extending between said pair of opposed panels for holding said panels in said spaced apart substantially parallel relationship;

first engagement means associated with the first and second end portions of each panel for removably attaching one pair of panels to a similarly constructed pair of panels in side-by-side relationship to each other; and second engagement means associated with the top and bottom longitudinal edges of each panel for stackably attaching one pair of panels to another similarly constructed pair of panels, said second engagement means including one row of alternating teeth and sockets associated with each of said top and bottom horizontal longitudinal edges, said one row of alternating teeth and sockets being positioned and located adjacent the opposing inner surfaces of said pair of opposing panels, the teeth associated with the top longitudinal edge being vertically aligned with the sockets associated with the bottom longitudinal edge, and a substantially flat planar surface positioned and located adjacent said one row of alternating teeth and sockets associated with said top and bottom longitudinal edges and extending substantially the full length thereof, said substantially flat planar surface being positioned and located adjacent the outer surface of each of said pair of panels such that the sockets positioned adjacent thereto open onto said substantially flat planar surface;

said pair of panels forming said block form being disposed relative to each other such that the teeth associated with the row of alternating teeth and sockets located adjacent the inner surface of one of said pair of panels are horizontally aligned with the sockets associated with the row of alternating teeth and sockets located adjacent the inner surface of the other of said pair of panels; and said second engagement means enabling one of said block forms to be vertically removably attached with a plurality of similarly constructed block forms regardless of the orientation of said block forms, the top longitudinal edges of one block form being engageable with both the top and bottom longitudinal edges of another similarly constructed block form, and the bottom longitudinal edges of one block form being engageable with both the top and bottom longitudinal edges of another similarly constructed block form.

22. The apparatus of claim 21 wherein said first engagement means associated with the first and second end portions of each panel includes two columns of alternating teeth and sockets, one column being offset from the other column, the location of the teeth associated with the first end portion of each of said panels corresponding with the sockets associated with the second end portion of each of said panels and the location of the sockets associated with the first end portion of each of said panels corresponding with the location of the teeth associated with the second end portion of each of said panels; and said pair of panels forming said block form being disposed relative to each other such that the teeth associated with said first engagement means and with the row of alternating teeth and sockets located adjacent the outer surface of one of said pair of panels are horizontally aligned with the sockets associated with said first engagement means and with the row of alternating teeth and sockets located adjacent the outer surface of the other of said pair of panels, and the teeth associated with said first engagement means and with the row of alternating teeth and sockets located adjacent the inner surface of one of said pair of panels are horizontally aligned with the sockets associated with said first engagement means and with the row of alternating teeth and sockets located adjacent the inner surface of the other of said pair of panels.

23. The apparatus of claim 21 wherein each of said plurality of ties includes a web portion positioned between a pair of opposed flange members, each flange member being encapsulated within one of said respective pair of opposing panels.

24. The apparatus of claim 23 wherein the web portion includes a pair of bridge members formed therein spaced parallel from each other and transverse to the opposing flange members.

25. The apparatus of claim 24 wherein the outer surface of each of said opposing panels includes indicator marking means along its central longitudinal axis to aid in severing said block form laterally into equal halves, said indicator marking means being positioned between said pair of bridge members such that severing of said block form will not interfere with either pair of bridge members.

26. The apparatus of claim 23 wherein each opposed flange member is sufficiently planar and of sufficient strength to function as an anchoring stud.

27. The apparatus of claim 26 wherein the outer surface of each of said opposed panels includes flange indicator means for identifying the location of the respective flange members associated with said plurality of ties.

28. The apparatus of claim 27 wherein said flange indicator means includes a ladder type design for both aligning respective ties when similarly constructed blocked forms are vertically stacked one upon the other, and for locating said flange members for use as anchoring studs.

29. The apparatus of claim 21 wherein said substantially flat planar surface is formed so as to taper away from said row of alternating teeth and sockets associated with the top and bottom longitudinal edges of each panel and towards the outer surface of each respective panel.

30. The apparatus of claim 21 wherein each opposing panel includes two substantially planar rectangular segments in angular relation to each other, each segment having at least one pair of opposing edges.

31. A foam block concrete form comprising:

a pair of opposing panels positioned and spaced apart in substantially parallel relationship to each other, each panel having top and bottom horizontal longitudinal edges, first and second end portions, and inner and outer surfaces;

a plurality of ties extending between said pair of opposed panels for holding said panels in said spaced apart substantially parallel relationship;

first engagement means associated with the first and second end portions of each panel for removably attaching one pair of panels to a similarly constructed pair of panels in side-by-side relationship to each other; and second engagement means associated with the top and bottom longitudinal edges of each panel for stackably attaching one pair of panels to another similarly constructed pair of panels, said second engagement means including one row of alternating teeth and sockets associated with each of said top and bottom horizontal longitudinal edges, said one row of alternating teeth and sockets being positioned and located adjacent the opposing outer surfaces of said pair of opposing panels, the teeth associated with the top longitudinal edge being vertically aligned with the sockets associated with the bottom longitudinal edge, and a substantially flat planar surface positioned and located adjacent said one row of alternating teeth and sockets associated with said top and bottom longitudinal edges and extending substantially the full length thereof, said substantially flat planar surface being positioned and located adjacent the inner surface of each of said pair of panels such that the sockets positioned adjacent thereto open onto said substantially flat planar surface; said pair of panels forming said block form being disposed relative to each other such that the teeth associated with the row of alternating teeth and sockets located adjacent the outer surface of one of said pair of panels are horizontally aligned with the sockets associated with the row of alternating teeth and sockets located adjacent the outer surface of the other of said pair of panels; and said second engagement means enabling one of said block forms to be vertically removably attached with a plurality of similarly constructed block forms regardless of the orientation of said block forms, the top longitudinal edges of one block form being engageable with both the top and bottom longitudinal edges of another similarly constructed block form, and the bottom longitudinal edges of one block form being engageable with both the top and bottom longitudinal edges of another similarly constructed block form.

32. The apparatus of claim 31 wherein said first engagement means associated with the first and second end portions of each panel includes two columns of alternating teeth and sockets, one colunm being offset from the other column, the location of the teeth associated with the first end portion of each of said panels corresponding with the sockets associated with the second end portion of each of said panels and the location of the sockets associated with the first end portion of each of said panels corresponding with the location of the teeth associated with the second end portion of each of said panels; and said pair of panels forming said block form being disposed relative to each other such that the teeth associated with said first engagement means and with the row of alternating teeth and sockets located adjacent the outer surface of one of said pair of panels are horizontally aligned with the sockets associated with said first engagement means and with the row of alternating teeth and sockets located adjacent the outer surface of the other of said pair of panels, and the teeth associated with said first engagement means and with the row of alternating teeth and sockets located adjacent the inner surface of one of said pair of panels are horizontally aligned with the sockets associated with said first engagement means and with the row of alternating teeth and sockets located adjacent the inner surface of the other of said pair of panels.

33. The apparatus of claim 31 wherein each of said plurality of ties includes a web portion positioned between a pair of opposed flange members, each flange member being encapsulated within one of said respective pair of opposing panels.

34. The apparatus of claim 33 wherein the web portion includes a pair of bridge members fonned therein spaced parallel from each other and transverse to the opposing flange members.

35. The apparatus of claim 34 wherein the outer surface of each of said opposing panels includes indicator marking means along its central longitudinal axis to aid in severing said block form laterally into equal halves, said indicator marking means being positioned between said pair of bridge members such that severing of said block form will not interfere with either pair of bridge members.

36. The apparatus of claim 33 wherein each opposed flange member is sufficiently planar and of sufficient strength to function as an anchoring stud.

37. The apparatus of claim 36 wherein the outer surface of each of said opposed panels includes flange indicator means for identifying the location of the respective flange members associated with said plurality of ties.

38. The apparatus of claim 37 wherein said flange indicator means includes a ladder type design for both aligning respective ties when similarly constructed blocked forms are vertically stacked one upon the other, and for locating said flange members for use as anchoring studs.

39. The apparatus of claim 31 wherein said substantially flat planar surface is formed so as to taper away from said row of alternating teeth and sockets associated with the top and bottom longitudinal edges of each panel and towards the inner surface of each respective panel.

40. The apparatus of claim 31 wherein each opposing panel includes two substantially planar rectangular segments in angular relation to each other, each segment having at least one pair of opposing edges.

* * * * *

UNITED STATES PATENT AND TRADEMARK OFFICE

CERTIFICATE OF CORRECTION

PATENT NO. : 7,409,801 B2
APPLICATION NO. : 10/906794
DATED : August 12, 2008
INVENTOR(S) : Henry E. Pfeiffer It is certified that error appears in the above-identified patent and that said Letters Patent is hereby corrected as shown below:

Col. 18, line 26, delete “colunm” and replace with -- column --
Col. 18, line 54, delete “fonned” and replace with -- formed --

Signed and Sealed this

Seventh Day of October, 2008

JON W. DUDAS
*Director of the United States Patent and Trademark Office*